US007665955B2

(12) United States Patent
Liang

(10) Patent No.: US 7,665,955 B2
(45) Date of Patent: Feb. 23, 2010

(54) VORTEX COOLED TURBINE BLADE OUTER AIR SEAL FOR A TURBINE ENGINE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 520 days.

(21) Appl. No.: 11/506,085

(22) Filed: Aug. 17, 2006

(65) Prior Publication Data

US 2009/0285671 A1 Nov. 19, 2009

(51) Int. Cl.
*F01D 25/12* (2006.01)
*F01D 11/08* (2006.01)

(52) U.S. Cl. ..... 415/115; 415/173.1

(58) Field of Classification Search ..... 415/115, 415/173.1; 416/96 R, 97 R
See application file for complete search history.

(56) References Cited

U.S. PATENT DOCUMENTS

| | | | | |
|---|---|---|---|---|
| 3,031,132 | A | 4/1962 | Davies | |
| 3,365,172 | A | 1/1968 | McDonough et al. | |
| 3,411,794 | A | 11/1968 | Allen | |
| 3,529,905 | A | 9/1970 | Meginnis | |
| 3,603,599 | A | 9/1971 | Laird | |
| 3,719,365 | A | 3/1973 | Emmerson et al. | |
| 3,754,766 | A | 8/1973 | Asplund | |
| 4,017,207 | A * | 4/1977 | Bell et al. | 415/115 |
| 4,037,414 | A | 7/1977 | Nicodemus | |
| 4,422,648 | A | 12/1983 | Eaton et al. | |
| 4,425,078 | A | 1/1984 | Robbins | |
| 4,573,866 | A | 3/1986 | Sandy, Jr. et al. | |
| 4,596,511 | A | 6/1986 | Weinrib | |
| 4,669,957 | A * | 6/1987 | Phillips et al. | 416/97 R |
| 4,818,178 | A | 4/1989 | Sibbertsen | |
| 5,088,888 | A | 2/1992 | Bobo | |
| 5,236,302 | A | 8/1993 | Weisgerber et al. | |
| 5,374,161 | A | 12/1994 | Kelch et al. | |
| 5,375,973 | A * | 12/1994 | Sloop et al. | 415/173.1 |
| 5,752,802 | A | 5/1998 | Jones | |
| 5,988,975 | A | 11/1999 | Pizzi | |
| 6,170,831 | B1 | 1/2001 | Bouchard | |
| 6,464,455 | B2 | 10/2002 | Wilson | |
| 6,508,623 | B1 * | 1/2003 | Shiozaki et al. | 415/173.1 |

(Continued)

FOREIGN PATENT DOCUMENTS

| | | |
|---|---|---|
| EP | 0541250 A1 | 5/1993 |

(Continued)

*Primary Examiner*—Edward Look
*Assistant Examiner*—Nathaniel Wiehe

(57) ABSTRACT

A cooling system for a turbine blade outer air seal that is positioned in close proximity to a tip of a rotatable turbine airfoil to seal the gap between the tip of the turbine blade and the blade ring carrier. The turbine blade outer air seal may be formed from a housing including a cooling fluid collection chamber and one or more vortex cooling channels in fluid communication with the cooling fluid collection chamber via one or more vortex channel feed holes. In one embodiment, a plurality of vortex cooling channels may extend from proximate to an upstream edge of an outer sealing plate of the outer air seal to a downstream edge of the outer sealing plate. During use, cooling fluids pass through the vortex channel feed holes and into the vortex cooling channels, in which vortices may be created.

16 Claims, 3 Drawing Sheets

U.S. PATENT DOCUMENTS

| | | | | |
|---|---|---|---|---|
| 6,895,752 | B1 | 5/2005 | Holtman et al. | |
| 2005/0067788 | A1 | 3/2005 | Liang | |
| 2007/0014664 | A1 * | 1/2007 | Dellmann et al. | 416/97 R |

FOREIGN PATENT DOCUMENTS

| | | | |
|---|---|---|---|
| JP | 58214603 | A | 12/1983 |
| JP | 59034402 | A | 2/1984 |
| JP | 59051105 | A | 3/1984 |
| JP | 59134307 | A | 8/1984 |
| JP | 60045702 | A | 3/1985 |
| JP | 60088801 | A | 5/1985 |
| WO | WO 99/63283 | A1 | 12/1999 |
| WO | WO 00/63534 | A1 | 10/2000 |

* cited by examiner

VORTEX COOLED TURBINE BLADE OUTER AIR SEAL FOR A TURBINE ENGINE

FIELD OF THE INVENTION

This invention is directed generally to turbine airfoils, and more particularly to cooling systems in outer air seals proximate to turbine blades in turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. Turbine blades and other components often contain cooling systems for prolonging the life of the blades and reducing the likelihood of failure as a result of excessive temperatures.

Turbine blades typically extend radially from a rotor assembly and terminate at a tip within close proximity of the outer air seals attached to a shroud. The outer air seals may be exposed to the hot combustion gases and, similar to the turbine blades, the outer air seals often rely on internal cooling systems to reduce stress and increase the life cycle. Conventional cooling systems in the outer air seals often require large cooling fluid supply flows. Thus, a need exists for a more efficient cooling system for a turbine blade outer air seal.

SUMMARY OF THE INVENTION

This invention relates to a cooling system in a turbine blade outer air seal usable in turbine engines. The turbine blade outer air seal may be positioned radially outward from a tip of a rotatable turbine blade and in close proximity to the turbine blade tip. The outer air seal may be formed from an outer seal housing having at least one outer sealing plate with a slight curvature that follows a rotational path of a tip of a turbine blade. The outer air seal may also include a cooling fluid collection chamber positioned in the outer seal housing and including an inlet for receiving cooling fluids from a cooling fluid supply source. The outer air seal may include one or more vortex cooling channels in the outer seal housing and positioned in close proximity to an outer sealing surface of the outer sealing plate for cooling the outer sealing plate. The vortex cooling channel may extend from a position proximate to an upstream edge of the at least one outer sealing plate to a downstream edge of the at least one outer sealing plate such that cooling fluids may be exhausted through an exhaust orifice in the downstream edge. The outer air seal may include a plurality of vortex cooling channels extending from a position proximate to the upstream edge of the at least one outer sealing plate to the downstream edge of the at least one outer sealing plate such that cooling fluids may be exhausted through exhaust orifices in the downstream edge, wherein each vortex cooling channel forms an independent cooling channel. The vortex cooling channels may be positioned generally parallel to each other and may be spaced equally from each other.

One or more vortex channel feed holes may extend through a rib separating the cooling fluid collection chamber and the at least one vortex cooling channel to place the at least one vortex channel in fluid communication with the cooling fluid collection chamber. The vortex channel feed hole may tangentially intersect an outer surface forming the at least one vortex cooling channel such that cooling fluids flowing from the vortex channel feed hole into the at least one vortex cooling channel flow along the outer surface of the at least one vortex cooling channel and form a vortex therein. The at least one vortex channel feed hole comprises a plurality of vortex channel feed holes positioned along the length of the at least one vortex cooling channel. The cooling system may be controlled by sizing the vortex channel feed holes differently to customize the cooling fluid flow based on different localized heat loads. In at least one embodiment, at least two vortex channel feed holes of the plurality of vortex channel feed holes have different cross-sectional areas to control flow of cooling fluids through the vortex channel feed holes into the at least one vortex cooling channel.

The cooling system may also include one or more side edge exhaust orifices extending between a first side edge of the outer sealing plate and one of the plurality of vortex cooling channels in closest proximity to the first side edge of the at least one outer sealing plate. The cooling system may also include one or more side edge exhaust orifices extending between a second side edge of the outer sealing plate generally opposite to the first side edge and one of the plurality of vortex cooling channels in closest proximity to the second side edge of the at least one outer sealing plate. Thus, the cooling system may exhaust cooling fluids on both side edges of the outer air seal and from a downstream edge of the outer air seal. In at least one embodiment, the side edge exhaust orifices extending through the second side edge of the outer sealing plate may be offset from the side edge exhaust orifices extending through the first side edge. Thus, when two seal plates are placed together, the side edge exhaust orifices of the plates do not eject cooling fluids against each other. Rather, impingement cooling of the side edge occurs by cooling air impinging on the side edge of the adjacent seal plate.

During use, cooling fluids may be supplied from a cooling fluid supply source through the blade ring carrier to the cooling fluid collection chamber. The cooling fluids impinge onto a backside of the impingement rib and flow through the impingement orifices. The cooling fluids collect in the impingement chamber and then pass into the vortex channel feed holes. The vortex channel feed holes may be offset from a longitudinal axis of the holes, such as the holes may be tangential with the outer surfaces, and thus create vortices of the cooling fluids as the cooling fluids flow into the vortex cooling channels. The vortexed cooling fluids flow aftward toward the downstream edge and the exhaust orifices while spinning in a vortex. Additional cooling fluids may be added along the flow path via additional vortex channel feed holes. Each vortex cooling channel may be sized based upon the localized heat loads. The trip strips increase the convection rate as the cooling fluids flow through the vortex cooling channels. The spent cooling fluids may be discharged from the system through the exhaust orifices and into the downstream interface cavity to provide additional film cooling for the downstream component and to purge air from the cavity.

An advantage of this invention is that the vortex cooling channels in the turbine blade outer air seal increase the convection rated in the cooling system by creating vortices of the cooling fluids.

Another advantage of this invention is that the vortexed cooling fluids reduce the cooling fluid flow requirement and reduce the operating temperature of the turbine blade outer air seal.

Yet another advantage of this invention is that the channel feed holes may be positioned along the length of the vortex cooling channels to resupply the vortex cooling channels with fresh cooling fluids to continue the vortex and to reduce the temperature of the cooling fluids in the vortex cooling channels.

Another advantage of this invention is that the cooling fluid delivered to each vortex channel may be independently controlled by varying the size of the vortex channel feed holes so that each vortex channel may be configured for the local heat load and in addition, a local over temperature may be accounted for by increasing the size of the appropriate vortex channel feed holes to supply additional cooling fluids to the area. Thus, the temperature of each vortex channel may be individually tuned.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
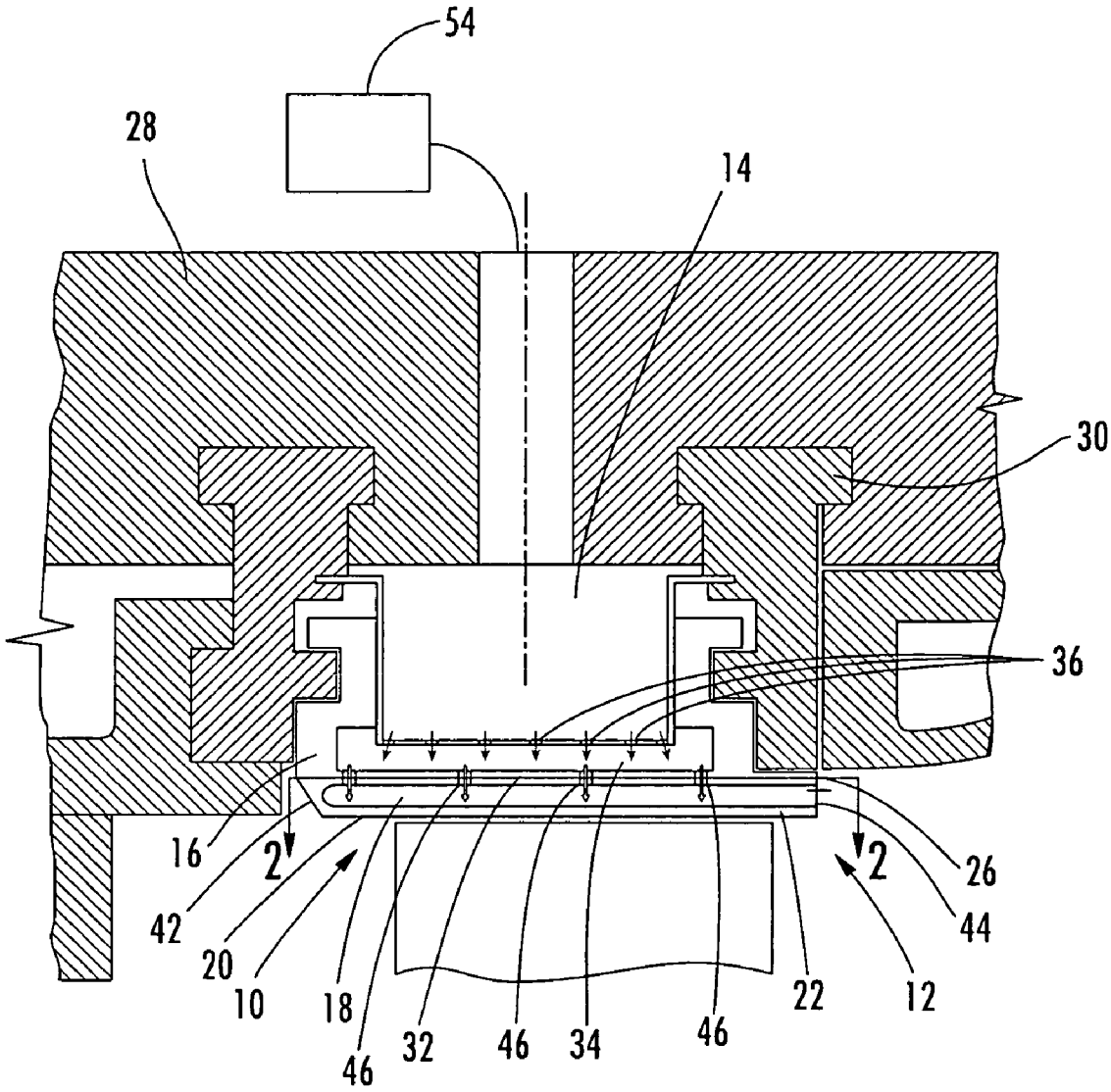
FIG. 1 is a cross-sectional view of a blade ring carrier and isolation ring containing an outer air seal having aspects of this invention.

As shown in FIGS. 1-5, this invention is directed to a turbine blade outer air seal cooling system 10 for a turbine blade outer air seal 12 used in turbine engines. In particular, the turbine blade outer air seal cooling system 10 may include one or more cooling fluid collection chambers 14 positioned with an outer seal housing 16 and in fluid communication with one or more vortex cooling channels 18 in the outer seal housing 16. The vortex cooling channels 18 may be positioned in close proximity to an outer sealing surface 20 on an outer plate 22 of the outer seal housing 16. The vortex cooling channels 18 may be in fluid communication with the cooling fluid collection chamber 14 to receive cooling fluids to create one or more vortices in the vortex cooling channels 18. The cooling fluids may flow through the vortex cooling channels 18 in a general vortex motion and be expelled on side surfaces 24 and a downstream edge 26 of the outer plate 22.

The turbine blade outer air seal 12 may be formed from any device capable of positioning the outer plate 22 within close proximity to the outer sealing surface 20. In at least one embodiment, the turbine blade outer air seal 12 may be formed from a outer seal housing 16 configured to be attached to a blade ring carrier 28 via an isolation ring 30. The isolation ring 30 may be formed of conventional configuration and configured to be attached within recesses within the blade ring carrier 28. The blade ring carrier 28 may likewise be formed from a conventional design. The turbine blade outer air seal 12 may be formed from an outer seal housing 16 configured to include one or more cooling fluid collection chambers 14. The cooling fluid collection chamber 14 may have any appropriate configuration. In at least one embodiment, the cooling fluid collection chamber 14 may be a single chamber positioned within a central aspect of the outer seal housing 16. The outer seal housing 16 may also include an impingement rib 32 in the cooling fluid collection chamber 14 and forming an impingement chamber 34. The impingement rib 32 may include a plurality of impingement orifices 36 through which cooling fluids may pass. The impingement orifices 36 may be sized to control the flow of cooling fluids from the cooling fluid collection chamber 14.

The turbine blade outer air seal cooling system 10 may include one or more vortex cooling channels 18 positioned in close proximity to the outer sealing surface 20. In at least one embodiment, the vortex cooling channels 18 may be positioned in the outer plate 22 forming the outer sealing surface 20. In other embodiments, the vortex cooling channels 18 are not positioned in the outer plate 22 but instead are positioned immediately adjacent to the outer plate 22, thereby positioning the vortex cooling channels 18 in close proximity to the outer sealing surface 20.

Figure 2:
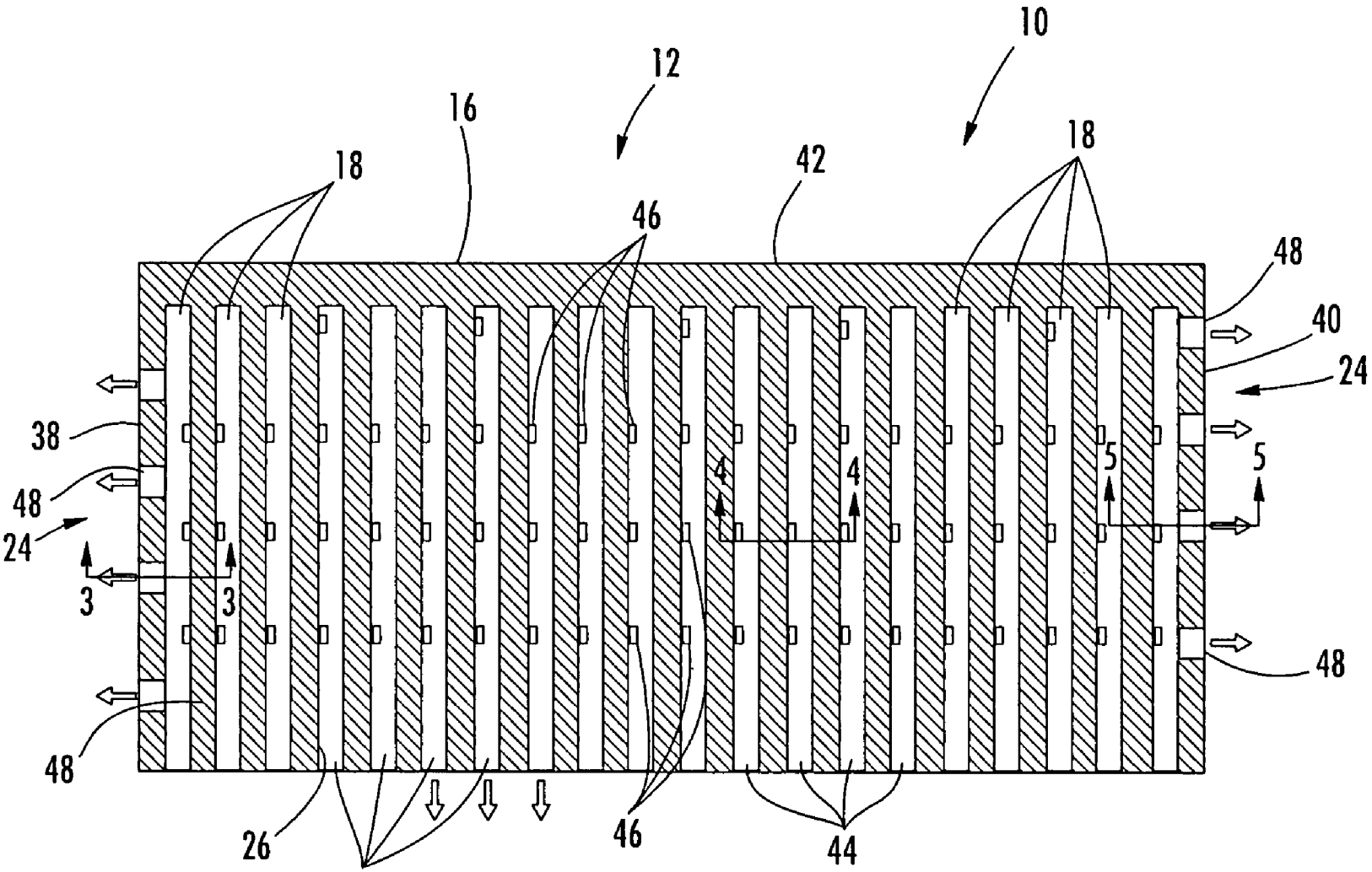
FIG. 2 is a cross-sectional view of the outer air seal shown in FIG. 1 taken along line 2-2.

As shown in FIG. 2, the turbine blade outer air seal cooling system 10 may include a plurality of vortex cooling channels 18. The vortex cooling channels 18 may form independent cooling channels. The vortex cooling channels 18 may be generally aligned with each other. In at least one embodiment, the vortex cooling channels 18 may be aligned with first and second side surfaces 38, 40 of the outer plate 22. The vortex cooling channels 18 may be positioned generally parallel to each other and may or may not be equally spaced from each other, as shown in FIG. 2. The vortex cooling channels 18 may extend from proximate to an upstream edge 42 of the outer plate 22 to the downstream edge 26. The vortex cooling channels 18 may exhaust cooling fluids through exhaust orifices 44 in the downstream edge 26.

The vortex cooling channels 18 may receive cooling fluids through one or more vortex channel feed holes 46. In at least one embodiment, the vortex channel feed holes 46 may extend through a rib 32 separating the impingement chamber 34 from the vortex cooling channel 18. The vortex channel feed holes 46 may place the impingement chamber 34 in fluid communication with the vortex cooling channels 18. There may exist at least one vortex channel feed hole 46 in communication with each of the vortex cooling channels 18. For instance, a vortex channel feed hole 46 may feed cooling fluids to the vortex cooling channel 18 proximate to the upstream edge 42 of the outer plate 22. In other embodiments, the vortex cooling channels 18 may include a plurality of vortex channel feed holes 46 positioned along the length of the vortex cooling channels 18. The vortex channel feed holes 46 may refresh the vortices within the vortex cooling channels 18 as the cooling fluids flow toward the exhaust orifices 44 in the downstream edge 26.

Figure 3:
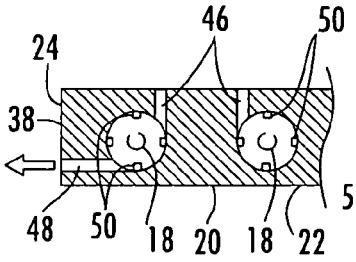
FIG. 3 is a detailed cross-sectional view of the outer air seal shown in FIG. 2 along line 3-3.
Figure 4:
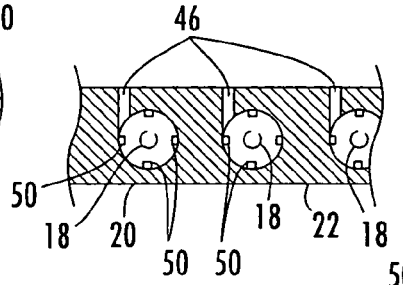
FIG. 4 is a detailed cross-sectional view of the outer air seal shown in FIG. 2 along line 4-4.
Figure 5:
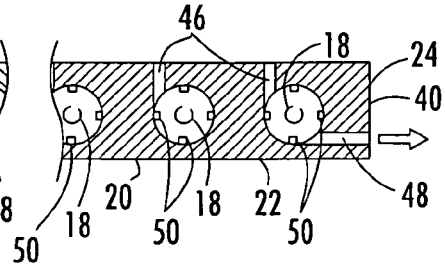
FIG. 5 is a detailed cross-sectional view of the outer air seal shown in FIG. 2 along line 5-5.

As shown in FIGS. 3-5, the vortex channel feed holes 46 may tangentially intersect an outer surface 52 of one of the vortex cooling channels 18 such that cooling fluids flowing from the vortex channel feed holes 46 into the vortex cooling channels 18 flow along the outer surfaces 52 of the vortex cooling channels 18 and form vortices therein. The vortex channel feed holes 46 may be individually sized to control the flow of cooling fluids to customize the flow pattern in the vortex cooling channels 18. The vortex channel feed holes 46 may also be sized to control the tangential velocity of the cooling fluids. Two or more of the vortex channel feed holes 46 may have different cross-sectional areas. The vortex channel feed holes 46 may be circular or have another configuration.

The turbine blade outer air seal cooling system 10 may also include one or more side edge exhaust orifices 48, as shown in FIGS. 3 and 5, extending from the vortex cooling channels 18 in closest proximity to the first and second side surfaces 38, 40 to the first and second side surfaces 38, 40. The side edge exhaust orifices 48 enable cooling fluids to be exhausted to the side surfaces 38, 40 to provide film cooling for a downstream component and to function as purge air for the cavity. In at least one embodiment, the side edge exhaust orifices 48 extending through the second side edge 40 of the outer sealing plate 22 may be offset from the side edge exhaust orifices 48 extending through the first side edge 38. Thus, when two seal plates 22 are placed together, the side edge exhaust orifices 48 of the plates 22 do not eject cooling fluids against each other. Rather, impingement cooling of the side edge 38 occurs by cooling air impinging on the side edge of the adjacent seal plate 22.

The vortex cooling channels 18 may also include one or more trip strips 50 for increasing the convection rate. In at least one embodiment, as shown in FIGS. 3-5, the vortex cooling channels 18 may include the trip strips 50 that extend generally axially within the vortex cooling channels 18.

During use, cooling fluids may be supplied from a cooling fluid supply source 54, through the blade ring carrier 28 to the cooling fluid collection chamber 14. The cooling fluids impinge onto a backside of the impingement rib 32 and flow through the impingement orifices 36. The cooling fluids collect in the impingement chamber 34 and then pass into the vortex channel feed holes 46. The vortex channel feed holes 46 may be offset from a longitudinal axis of the holes 46, such as the holes 46 may be tangential with the outer surfaces 52, and thus create vortices of the cooling fluids as the cooling fluids flow into the vortex cooling channels 18. The vortexed cooling fluids flow aftward toward the downstream edge 26 and the exhaust orifices 44 while spinning in a vortex. Additional cooling fluids may be added along the flow path via additional vortex channel feed holes 46. Each vortex cooling channel 18 may be sized based upon the localized heat loads. The trip strips 50 increase the convection rate as the cooling fluids flow through the vortex cooling channels 18. The spent cooling fluids may be discharged from the system 10 through the exhaust orifices 44 an into the downstream interface cavity to provide additional film cooling for the downstream component and to purge air from the cavity.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade outer air seal, comprising:

an outer seal housing having at least one outer sealing plate with a curvature that follows a rotational path of a tip of a turbine blade;

a cooling fluid collection chamber positioned in the outer seal housing and including an inlet for receiving cooling fluids from a cooling fluid supply source;

at least one vortex cooling channel in the outer seal housing, positioned proximate to an outer sealing surface of the outer sealing plate;

at least one vortex channel feed hole extending through a rib separating the cooling fluid collection chamber and the at least one vortex cooling channel to place the at least one vortex cooling channel in fluid communication with the cooling fluid collection chamber;

wherein the at least one vortex channel feed hole tangentially intersects an outer surface forming the at least one vortex cooling channel such that cooling fluids flowing from the at least one vortex channel feed hole into the at least one vortex cooling channel flow along the outer surface of the at least one vortex cooling channel and form a vortex therein:

wherein the at least one vortex cooling channel extends from a position proximate to an upstream edge of the at least one outer sealing plate to a downstream edge of the at least one outer sealing plate such that cooling fluids may be exhausted through an exhaust orifice in the downstream edge;

wherein the at least one vortex cooling channel comprises a plurality of vortex cooling channels extending from a position proximate to the upstream edge of the at least one outer sealing plate to the downstream edge of the at least one outer sealing plate such that cooling fluids may be exhausted through exhaust orifices in the downstream edge, wherein each vortex cooling channel forms an independent cooling channel; and at least one side edge exhaust orifice extending between a first side edge of the at least one outer sealing plate and one of the plurality of vortex cooling channels in closest proximity to the first side edge of the at least one outer sealing plate.

2. The turbine blade outer air seal of claim 1, wherein the at least one vortex channel feed hole comprises a plurality of vortex channel feed holes positioned along the length of the at least one vortex cooling channel.

3. The turbine blade outer air seal of claim 2, wherein at least two vortex channel feed holes of the plurality of vortex channel feed holes have different cross-sectional areas to control flow of cooling fluids through the vortex channel feed holes into the at least one vortex cooling channel.

4. The turbine blade outer air seal of claim 1, wherein the vortex cooling channels are positioned generally parallel to each other.

5. The turbine blade outer air seal of claim 4, wherein the vortex cooling channels are spaced equally from each other.

6. The turbine blade outer air seal of claim 1, further comprising at least one side edge exhaust orifice extending between a second side edge of the at least one outer sealing plate generally opposite to the first side edge and one of the plurality of vortex cooling channels in closest proximity to the second side edge of the at least one outer sealing plate, wherein the at least one side edge exhaust orifice extending between a second side edge is offset from the at least one side edge exhaust orifice extending between a first side edge.

7. The turbine blade outer air seal of claim 1, further comprising at least one trip strip extending radially within the at least one vortex cooling channel.

8. A turbine blade outer air seal, comprising:

an outer seal housing having at least one outer sealing plate with a curvature that follows a rotational path of a tip of a turbine blade;

a cooling fluid collection chamber positioned in the outer seal housing and including an inlet for receiving cooling fluids from a cooling fluid supply source;

a plurality of vortex cooling channels in the outer seal housing and positioned proximate to an outer sealing surface of the outer sealing plate;

at least one vortex channel feed hole in fluid communication with each of the plurality of vortex cooling channels and extending through a rib separating the cooling fluid collection chamber and the vortex cooling channels to place each of the vortex channels in fluid communication with the cooling fluid collection chamber;

wherein each of the vortex channel feed holes tangentially intersects an outer surface of one of the vortex cooling channels such that cooling fluids flowing from the vortex channel feed holes into the vortex cooling channels flow along the outer surfaces of the vortex cooling channels and form vortices therein; and at least one side edge exhaust orifice extending between a first side edge of the at least one outer sealing plate and one of the plurality of vortex cooling channels in closest proximity to the first side edge of the at least one outer sealing plate.

9. The turbine blade outer air seal of claim 8, wherein the plurality of vortex cooling channels extend from a position proximate to an upstream edge of the at least one outer sealing plate to a downstream edge of the at least one outer sealing plate such that cooling fluids may be exhausted through an exhaust orifice in the downstream edge.

10. The turbine blade outer air seal of claim 9, wherein the at least one vortex channel feed hole comprises a plurality of vortex channel feed holes positioned along the length of each of the plurality of vortex cooling channels.

11. The turbine blade outer air seal of claim 10, wherein at least two vortex channel feed holes of the plurality of vortex channel feed holes have different cross-sectional areas to control flow of cooling fluids through the vortex channel feed holes into the at least one vortex cooling channel.

12. The turbine blade outer air seal of claim 8, wherein the vortex cooling channels are positioned generally parallel to each other.

13. The turbine blade outer air seal of claim 8, wherein the vortex cooling channels are spaced equally from each other.

14. The turbine blade outer air seal of claim 8, further comprising at least one side edge exhaust orifice extending between a second side edge of the at least one outer sealing plate generally opposite to the first side edge and one of the plurality of vortex cooling channels in closest proximity to the second side edge of the at least one outer sealing plate, wherein the at least one side edge exhaust orifice extending between a second side edge is offset from the at least one side edge exhaust orifice extending between a first side edge.

15. A turbine blade outer air seal, comprising:

an outer seal housing having at least one outer sealing plate with a curvature that follows a rotational path of a tip of a turbine blade;

a cooling fluid collection chamber positioned in the outer seal housing and including an inlet for receiving cooling fluids from a cooling fluid supply source;

a plurality of vortex cooling channels in the outer seal housing and positioned proximate to an outer sealing surface of the outer sealing plate;

a plurality of vortex channel feed holes in fluid communication with each of the plurality of vortex cooling channels and extending through a rib separating the cooling fluid collection chamber and the vortex cooling channels to place each of the vortex channels in fluid communication with the cooling fluid collection chamber;

at least one side edge exhaust orifice extending between a first side edge of the at least one outer sealing plate and one of the plurality of vortex cooling channels in closest proximity to the first side edge of the at least one outer sealing plate;

at least one side edge exhaust orifice extending between a second side edge of the at least one outer sealing plate generally opposite to the first side edge and one of the plurality of vortex cooling channels in closest proximity to the second side edge of the at least one outer sealing plate;

wherein the at least one side edge exhaust orifice extending between a second side edge is offset from the at least one side edge exhaust orifice extending between a first side edge;

wherein the plurality of vortex cooling channels extend from a position proximate to an upstream edge of the at least one outer sealing plate to a downstream edge of the at least one outer sealing plate such that cooling fluids may be exhausted through an exhaust orifice in the downstream edge;

wherein the vortex channel feed holes are spaced along a length of each of the vortex cooling channels from proximate to the upstream edge of the at least one outer sealing plate to the downstream edge of the at least one outer sealing plate;

wherein each of the vortex channel feed holes tangentially intersects an outer surface of one of the vortex cooling channels such that cooling fluids flowing from the vortex channel feed holes into the vortex cooling channels flow along the outer surfaces of the at least one vortex cooling channels and form vortices therein.

16. The turbine blade outer air seal of claim 15, wherein at least two vortex channel feed holes of the plurality of vortex channel feed holes have different cross-sectional areas to control flow of cooling fluids through the vortex channel feed holes into the at least one vortex cooling channel.

* * * * *

UNITED STATES PATENT AND TRADEMARK OFFICE

CERTIFICATE OF CORRECTION

PATENT NO. : 7,665,955 B2
APPLICATION NO. : 11/506085
DATED : February 23, 2010
INVENTOR(S) : George Liang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 710 days.

Signed and Sealed this

Twenty-eighth Day of December, 2010

David J. Kappos

David J. Kappos
*Director of the United States Patent and Trademark Office*